US006991341B1

(12) United States Patent
Khor

(10) Patent No.: US 6,991,341 B1
(45) Date of Patent: Jan. 31, 2006

(54) ILLUMINABLE UMBRELLA

(76) Inventor: Fong Yong (Jane) Khor, 4601 Steed Dr., Austin, TX (US) 78749

( * ) Notice: Subject to any disclaimer, the term of this patent is extended or adjusted under 35 U.S.C. 154(b) by 0 days.

(21) Appl. No.: 10/405,012

(22) Filed: Apr. 1, 2003

(51) Int. Cl.
*A45B 3/02* (2006.01)

(52) U.S. Cl. ..... 362/102; 362/205; 362/394

(58) Field of Classification Search ..... 362/102, 362/202–203, 198–199, 205, 800; 136/910; 135/910, 16
See application file for complete search history.

(56) References Cited

U.S. PATENT DOCUMENTS 2,507,919 A * 5/1950 Mazzeo ..... 135/41
3,281,586 A * 10/1966 Gonzalez ..... 362/102
4,031,381 A * 6/1977 Carver ..... 362/102

* cited by examiner

*Primary Examiner*—Ali Alavi
(74) *Attorney, Agent, or Firm*—Patent & Trademark Services, INC; Joseph H. McGlynn

(57) ABSTRACT

An improved illuminable umbrella that automatically produces light on the apex of umbrella when in its open position. The hollow shaft (50) contains two electric wires (92, 94) that connects the conductive plates **(32*a*, 32*b*, 44) at each end of hubs, to the power supply (66) at the stump of the umbrella, and the light emitting device (20) at the apex of umbrella. The conductive plates at each end of the hubs are aligned to contact when the pivotable hub slides, upward along the shaft, toward the stationary hub. When in contact, the electric circuitry is complete to activate the light emitting device. A manual controller (62)** installed at the stump of the umbrella allows user to selectively turn off light emitting device when the umbrella is in open position.

2 Claims, 5 Drawing Sheets

ILLUMINABLE UMBRELLA

CROSS-REFERENCE TO RELATED APPLICATION

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to easy manufactured umbrellas bearing low-energy consumption flashing light visible during night and poor visibility conditions.

2. Background of the Invention

It is unquestionable many pedestrian accidents that occur during night and poor weather conditions are due to poor visibility. During rainy conditions, vehicle operators often find difficulty in being watchful for nearby pedestrians when their focus is on other vehicles on the road. On the other hand, most pedestrians carry umbrellas. The opened umbrellas that they carry could reduce the visibility of the pedestrians. Hence, it is worthwhile to study efforts to reduce this hazard, when the automobile industry and population are ever booming. The idea of having light at the apex of the umbrella could improve visibility of pedestrians during poor weather and night conditions.

A few illuminable umbrellas have been proposed. For example, in U.S. Pat. No. 4,031,381 to Carver (1977), the design requires a precise position of the conductors in order to connect the electrical current to turn on the light source. This calls for meticulous manufacturing of the umbrella parts. Any slight error during manufacturing will cause the conductors to slide beyond or under the range of contact. Thus, it is not easy to manufacture the umbrella, and prolong use of the umbrella will increase the chance of malfunction. Moreover, the design is not adaptable on automatic umbrellas. The more recent invention of illuminable umbrellas such as, U.S. Pat. No. 5,323,798 to Yang (1993), U.S. Pat. No. 5,126,922 to Andreasen (1992), and U.S. Pat. No. 4,848,385 to Pennella (1989) features lights not only on the apex of umbrella, but throughout either the hood, tips and skeleton of the umbrella. The disadvantage of this feature is the huge energy consumption costing more energy to power the umbrella.

Most of the inventions of illuminable umbrellas require customary manufacturing to enable the unique features to work. Therefore, the designs are not adaptable to any convention umbrella. Thus, increases the cost of manufacturing, since it requires special made shaft with specified indentation or cutout to enable a switch to be place in it.

BACKGROUND OF INVENTION—OBJECTS AND ADVANTAGES

Accordingly, besides the objects and advantages of the illuminable umbrella described in my above patent, several objects and advantages of the present invention are:

1. The umbrella uses a unique feature to enable the light emitting device (LED) unit, that is, the concept of electrical conduction via contact of conductive plate that can be added to a convention umbrella, be it automatic or manual operated. This feature is extremely adaptable to any umbrella, thus, provides easy manufacturing and cost reduction.

2. The umbrella design is waterproof as there is no direct exposure of parts to water contamination.

3. The umbrella design only allows LED unit to activate when the umbrella is in fully opened position. Several advantages of this feature includes:

- childproof as it prevents child play,
- less step to activate and deactivate the LED unit. The is especially for users who are forgetful and are in hurry to do other tasks,
- excellent energy conservation mechanism.

4. The umbrella design is very user friendly as it also allows option to turn LED unit off if a user desires to switch off LED unit when umbrella is in opened position.

5. The design requires very minimal cost of manufacturing because the invention does not require major customary work. Since the invention utilizes the mechanism of the existing umbrella for its operation, it does not require parts that will significantly alter the design of a convention umbrella. The features of the design are common elements which can be manufactured and installed easily to a conventional umbrella. It can be fitted in high-end, as well as low-end quality umbrellas.

Additional objects and advantages are to provide an illuminable umbrella, which can be used easily on poor weather condition for safety. When the umbrella is opened, light is turned on spontaneously, without requiring additional step to turn on/off the light unit. The umbrella is cheap to manufacture, as it is adaptable to any conventional umbrella.

SUMMARY

In accordance with the present invention, the illuminable umbrella comprises a hollow rod, a stationary hub having electric conductor means on the inferior of contact surface, a pivotable hub having electric conductors means on the superior contact surface, a plurality of rib elements which supports the umbrella hood, a compartment carrying power for operation and switch, an light emitting device (LED) unit on to of umbrella hood connected electrically via wires to power source.

DRAWING—FIGURES

DRAWINGS—REFERENCE NUMERALS

Figure 1:
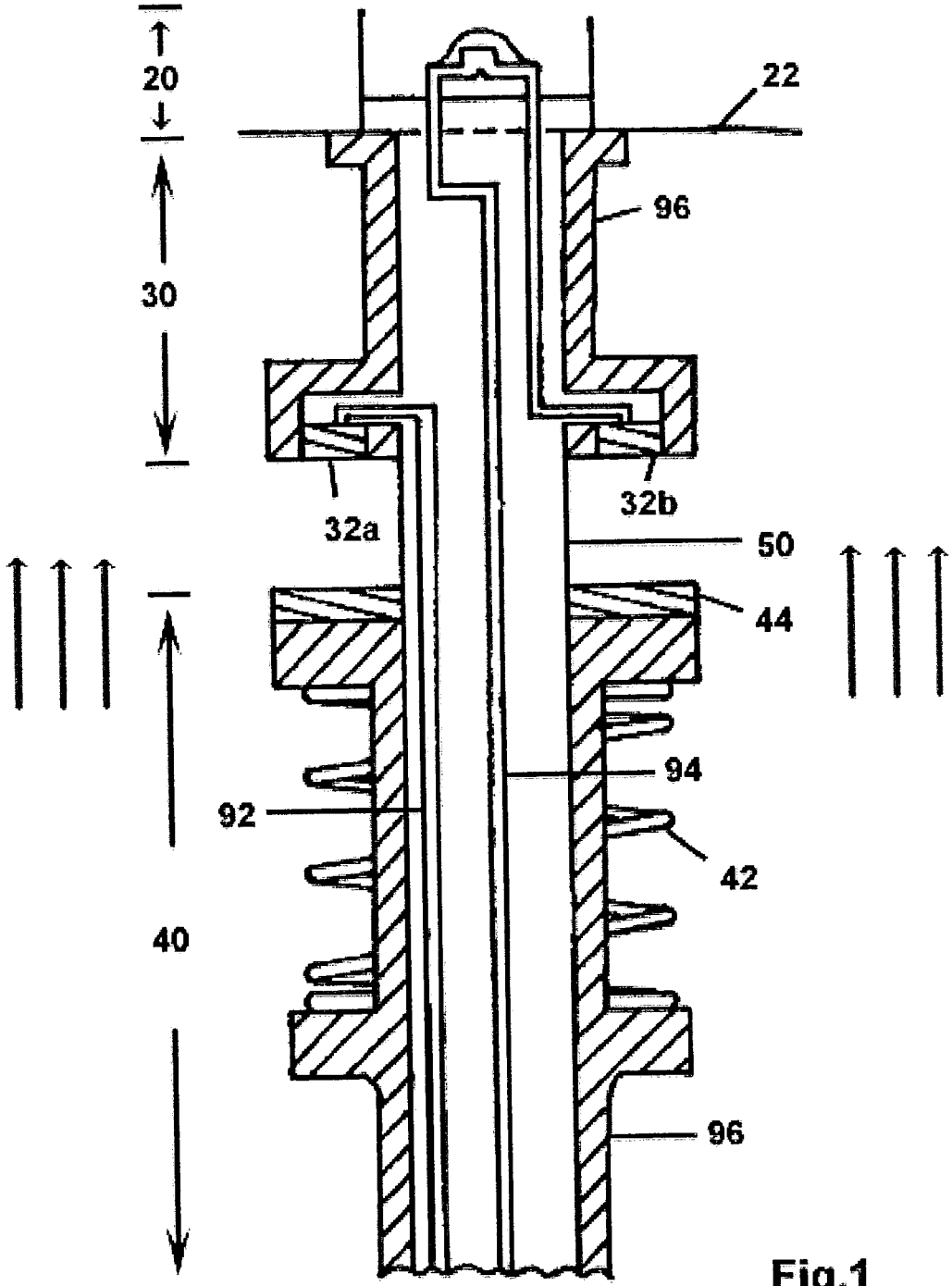
FIG. 1 shows a longitudinal cross section of an automatic umbrella comprises LED unit, stationary hub, and the pivotable hub with plurality of rib elements, which support an umbrella hood.

10 apex of the umbrella
20 Light emitting device (LED) unit
22 umbrella hood
24 plurality of ribs
30 stationary hub
32*a* conductive plate A
32*b* conductive plate B
40 pivotable hub
42 spring mechanism
44 conductive plate C
50 umbrella shaft
60 umbrella stump
62 manual on/off controller
64 on/off switch mechanism
66 power source
68 cap
70 hood release button
72 latch anchor
80 latch spring mechanism
92 insulated electric wire A
94 insulated electric wire B
96 part of hub

DETAILED DESCRIPTION OF THE INVENTION

FIGS. 1, 3, 4, 5A, 5B and 6—Automatic Embodiment

Figure 2:
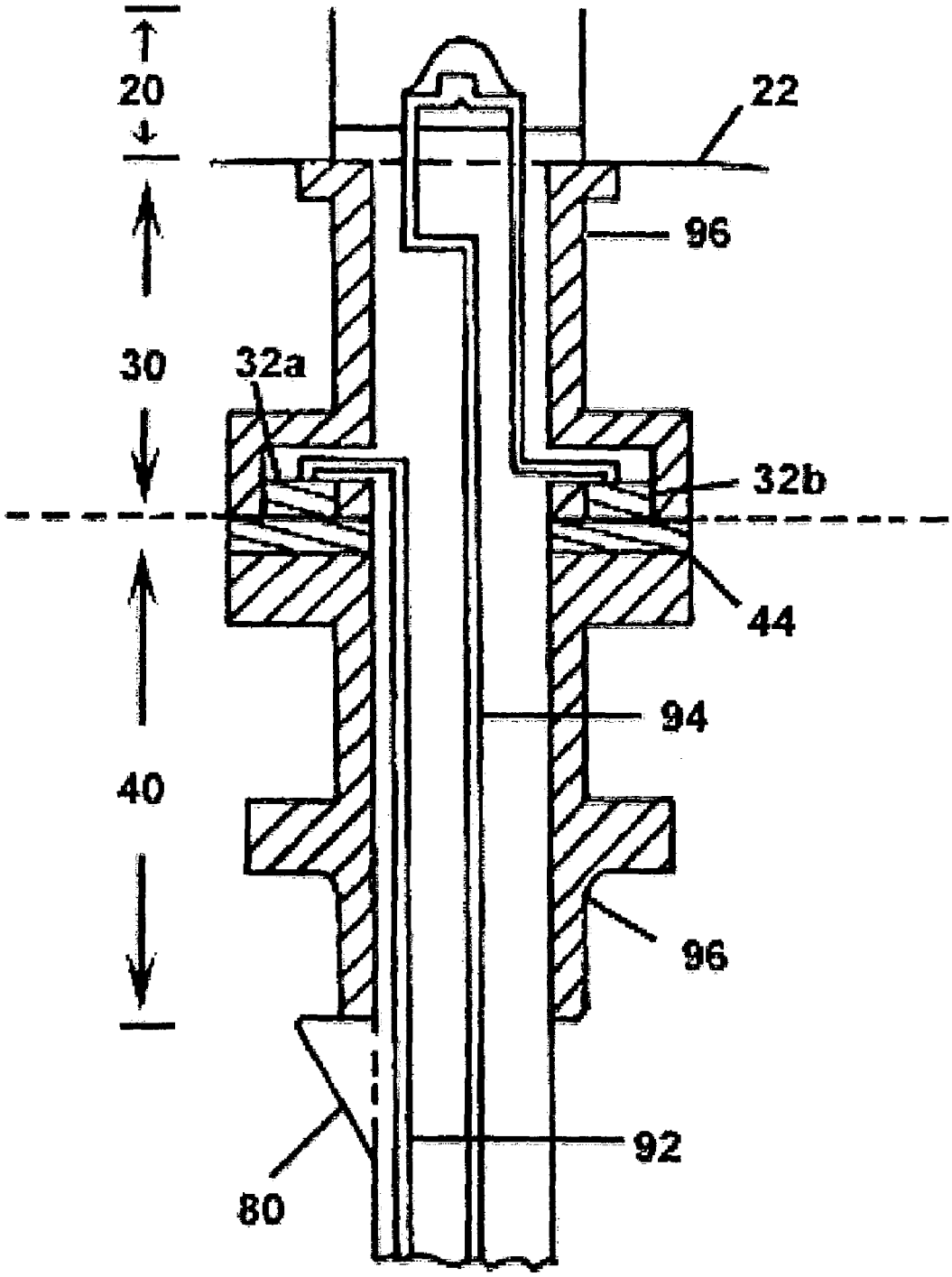
FIG. 2 shows a longitudinal cross section of a manual umbrella comprises LED unit, stationary hub, and the pivotable hub with plurality of rib elements, which support an umbrella hood.
Figure 5A:
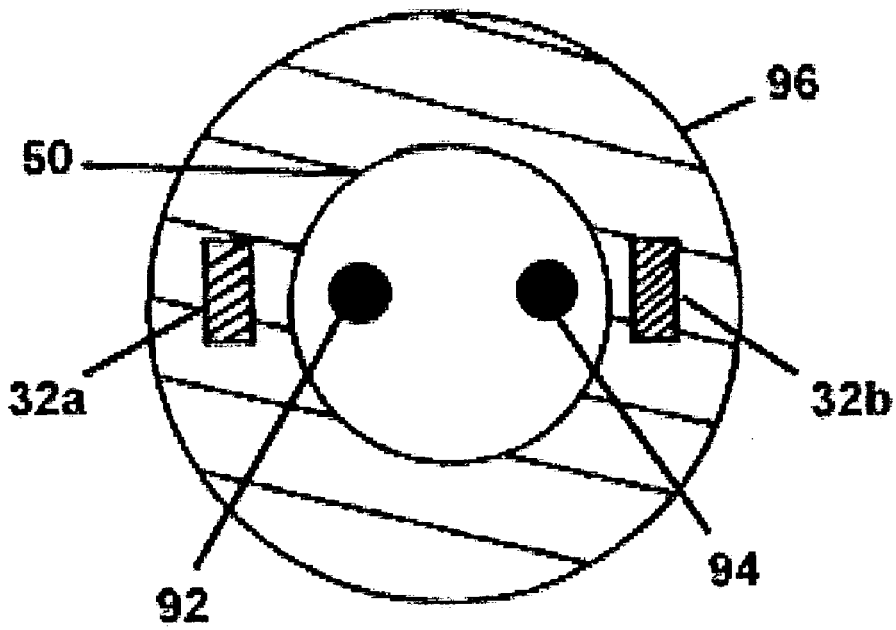
FIG. 5 shows a traverse cross section of the inferior surface of stationary hub or the superior surface of the pivotable hub.
Figure 6:
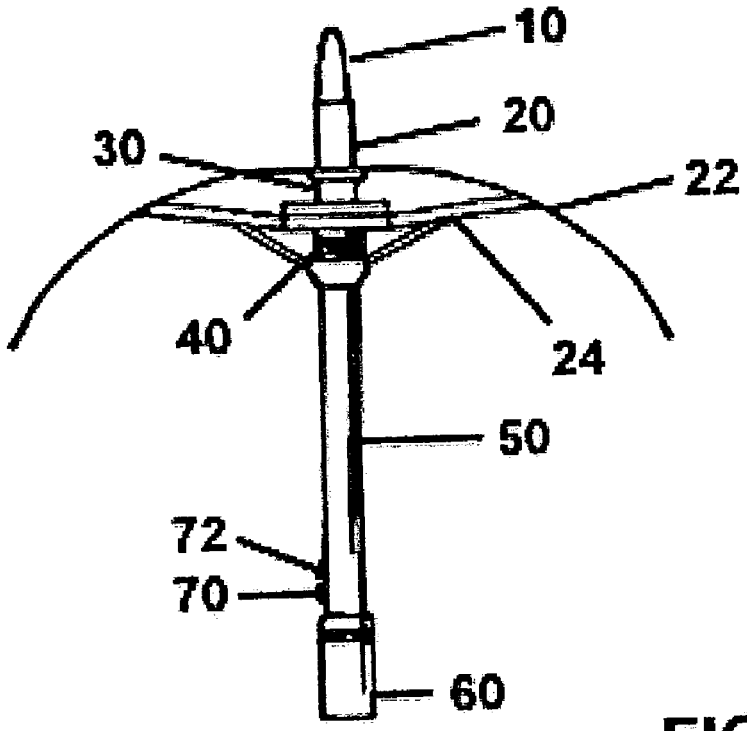
FIG. 6 shows tine frontal view of the full automatic umbrella.

Automatic embodiment of the present umbrella is illustrated in FIG. 1 and FIG. 6. The umbrella includes an apex 10, positioned above the LED light unit 20. The LED light unit is attached to an elongated hollow rod 50 with a handle 60 at its other end. The LED light unit is attached to stationary hub 30 on the outer and inner surface surrounding two conductive plates: plate A 32*a* and plate B 32*b*, in the center. The conductive plates are depicted in FIG. 1, FIG. 2 and FIG. 5A.

Figure 5B:
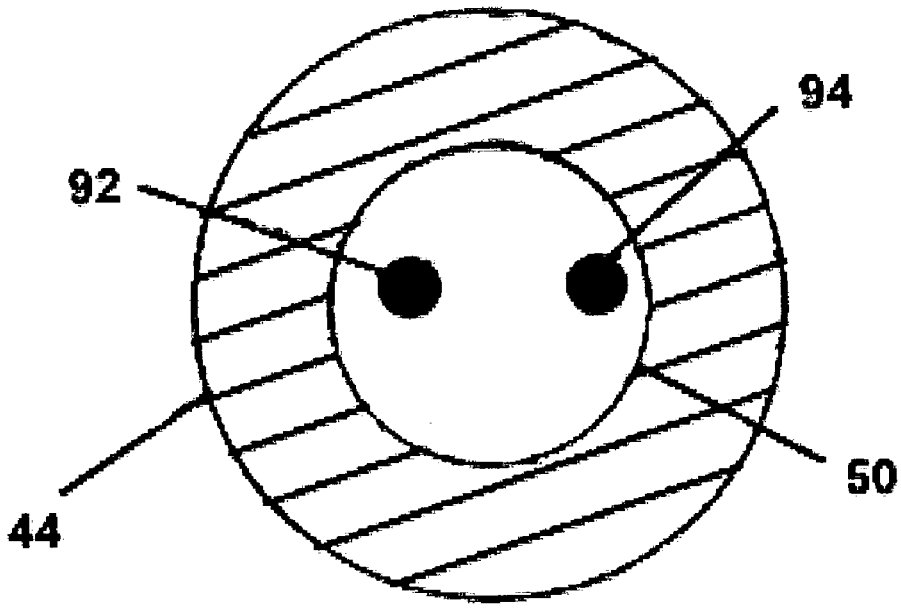

On an automatic umbrella, the pivotable hub 40 consists of a conductive plate 44, shown in FIG. 1 and FIG. 5B. The conductive plate 44 sits on top of the pivotable hub 40. The pivotable hub also consists of a spring mechanism 42 and a plurality of rib elements 24 which supports the umbrella hood, much like in a regular automatic umbrella. FIG. 6 shows the latch anchor 72 above the stump 60 of umbrella to lock the umbrella in a closed position.

The hollow rod 50 consists of two insulated electrical wires: wire A 92 and wire B 94. The ends of the wire A are the conductive plate A 32*a* on the stationary hub 30, and the power source 66 in the umbrella stump. The ends of the wire B 94 are the conductive plate B 32*b* on the stationary hub and the power source. Wire B is also connected to the circuit board of the LED unit 20.

Figure 4:
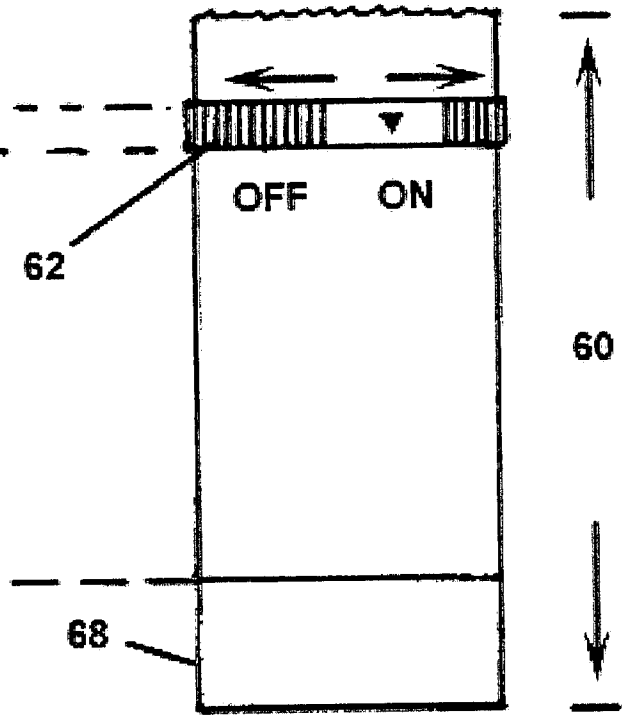
FIG. 4 shows a frontal view of the stump of the umbrella with on/off indicator is placed with a ring controller.
Figure 3:
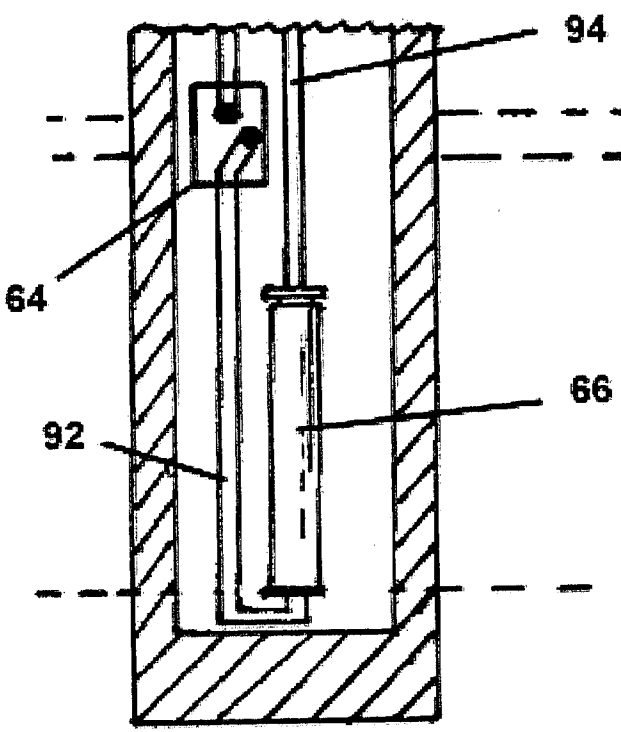
FIG. 3 shows a longitudinal cross section of the stump of the umbrella in which the battery storage and on/off switch is located.

The stump 60 of the umbrella carries the on/off switch mechanism 64 shown in detail in FIG. 3. The on/off switch gives user an option to turn off LED light unit 20 when the hood 22 is in opened position. The stump also includes the power supply 66, which is connected to wire A and B. Externally, as illustrated in FIG. 4, the stump has a controller 62 shaped like a ridged ring with "ON" and "OFF" indicator, and a cap 68 on the bottom for insertion of battery.

Figure 7:
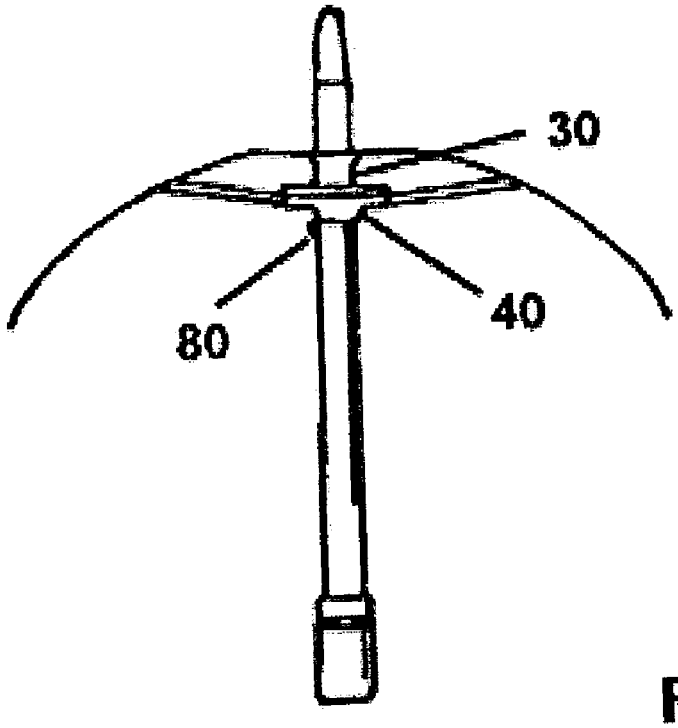
FIG. 7 shows the frontal view of the manual umbrella.

FIGS. 2 and 7—Manual Embodiment

The embodiment of the manual umbrella is similar to the automatic umbrella except it lacks the spring mechanism 42 present in the automatic umbrella to make the hood pop up automatically. Instead, the manual umbrella, as illustrated in FIG. 2, consists of a resilient latch element 80 much similar to traditional umbrella to hold the pivotable hub 40 in place to maintain the hood in open position.

FIGS. 1, 2, 6, 7

The manner of using the illuminable umbrella is identical to that for umbrella in present use. When the latch released button 70 is pushed, the automatic umbrella hood 22 opens. The pivotable hub 40 slides along the hollow shaft 50 and stops in contact with the stationary hub 30. When the conductive plates A 32*a* and B 32*b* on the stationary hub touch the surface of the conductive plate 44 on the pivotable hub, the circuitry is complete for the LED unit 20 to turn on. Light remains flashing as long as the conductive plates are in contact.

With the manual umbrella, the pivotable hub 40 is pushed upward along the shaft 50 and anchored on a resilient latch element 80 to keep hood in open position. At this position, the stationary hub 30 and pivotable hub 40 is in contact via the conductive plates. Thus the circuitry is complete.

When the umbrella is closed by manually sliding the pivotable hub 40 along the shaft 50 away from the stationary hub 30 and towards the stump 60 of umbrella, the circuit is disconnected. Thus the LED light unit 20 is turned off. The pivotable hub 40 continues to slide until it is locked on latch anchor 72.

As depicted in FIG. 3 and FIG. 4, the internal of the stump consists of an on/off switch 64 which is governed by the external controller 62 shaped like a ridged ring for easy grip. The controller 62 allows user to turn off the LED unit 20 when the hood is in opened position. The two wires 92, 94 are connected to the power source 66 which is replaceable by opening the cap 68 at the bottom of the stump.

I claim:

1. An illuminable umbrella comprising:

a shaft, said shaft being hollow, said shaft having a top portion and a bottom portion, a stationary hub secured to said shaft, said stationary hub projecting outwardly from said shaft, said stationary hub having an upper surface adjacent said top portion of said shaft and a bottom surface facing away from said top portion of said shaft, electrical contacts positioned in said bottom surface, a pivotable hub secured to said shaft, said pivotable hub projecting outwardly from said shaft, said pivotable hub having an upper surface adjacent said top portion of said shaft and a bottom surface facing away from said top portion of said shaft, electrical contacts positioned in said upper surface of said pivotable hub, said pivotable hub being movable along said shaft from a first position to a second position, said electrical contacts in said pivotable hub are out of electrical engagement with said electrical contacts in said stationary hub when said pivotable hub is in said first position, and said electrical contacts in said pivotable hub are in electrical engagement with said electrical contacts in said stationary hub when said pivotable hub is in said second position, and means for mounting a light emitting device to said shaft, and a power supply secured to said shaft, and conductive means for connecting said power supply to said light emitting device.

2. The illuminable umbrella as claimed in claim 1, wherein said electrical contacts are made from rust free material.

* * * * *